US011560981B2

(12) United States Patent
Bang et al.

(10) Patent No.: US 11,560,981 B2
(45) Date of Patent: Jan. 24, 2023

(54) MEMBRANE FINISHING SHEET AND MEMBRANE INSULATION STRUCTURE COMPRISING THE SAME

(71) Applicant: DAEWOO SHIPBUILDING & MARINE ENGINEERING CO., LTD., Geoje-si (KR)

(72) Inventors: Kang Je Bang, Goyang-si (KR); Joong Kyoo Kang, Geoje-si (KR); Hoon Taek Oh, Goyang-si (KR); Byung Hwa Kim, Goyang-si (KR)

(73) Assignee: DAEWOO SHIPBUILDING & MARINE ENGINEERING CO., LTD., Geoje-Si (KR)

( * ) Notice: Subject to any disclaimer, the term of this patent is extended or adjusted under 35 U.S.C. 154(b) by 302 days.

(21) Appl. No.: 16/621,101

(22) PCT Filed: Dec. 27, 2018

(86) PCT No.: PCT/KR2018/016707
§ 371 (c)(1),
(2) Date: Dec. 10, 2019

(87) PCT Pub. No.: WO2019/132532
PCT Pub. Date: Jul. 4, 2019

(65) Prior Publication Data

US 2021/0140585 A1 May 13, 2021

(30) Foreign Application Priority Data

Dec. 28, 2017 (KR) ..... 10-2017-0182748

(51) Int. Cl.
*F17C 3/02* (2006.01)
*B63B 25/16* (2006.01)

(52) U.S. Cl.
CPC ..... *F17C 3/027* (2013.01); *B63B 25/16* (2013.01)

(58) Field of Classification Search
CPC . B63B 25/00; B63B 25/16; F17C 3/00; F17C 3/02; F17C 3/027
(Continued)

(56) References Cited

FOREIGN PATENT DOCUMENTS

CN 105283704 A 1/2016
KR 10-2005-0050170 A 5/2005
(Continued)

OTHER PUBLICATIONS

International Search Report of corresponding PCT Application No. PCT/KR2018/016707—5 pages (dated Apr. 12, 2019).
(Continued)

*Primary Examiner* — Lars A Olson
(74) *Attorney, Agent, or Firm* — Knobbe, Martens, Olson & Bear, LLP

(57) ABSTRACT

A membrane finishing sheet, which is disposed at a membrane finishing part among multiple membrane sheets which form a sealing wall installed at a membrane type cargo, comprises a corrugated part having a structure closed in a direction toward the membrane finishing part. In addition, a membrane insulation structure comprising a membrane finishing sheet according to the present invention comprises a membrane finishing sheet disposed at a membrane finishing part among multiple membrane sheets which form a sealing wall installed at a membrane type cargo. Among four sides of the membrane finishing sheet, a finishing side in contact with the membrane finishing part has a structure in which the corrugated part is closed and thus provides a membrane insulation structure that does not require a separate finishing member for sealing a membrane.

5 Claims, 3 Drawing Sheets

(58) Field of Classification Search
USPC ..... 220/560.06
See application file for complete search history.

(56) References Cited

FOREIGN PATENT DOCUMENTS

| | | | | | |
|---|---|---|---|---|---|
| KR | 10-0706509 | B1 | | 4/2007 | |
| KR | 10-2010-0138165 | A | | 12/2010 | |
| KR | 10-2012-0104461 | A | | 9/2012 | |
| KR | 10-1280527 | B1 | | 7/2013 | |
| KR | 10-2015-0028438 | A | | 3/2015 | |
| KR | 10-2015-0076501 | A | | 7/2015 | |
| KR | 10-1617026 | B1 | | 4/2016 | |
| KR | 2017042873 | A | * | 4/2017 | ..... B63B 25/16 |

OTHER PUBLICATIONS

First Office Action of Chinese Patent Application No. 201880039039.0—16 pages (dated Jan. 27, 2021).

* cited by examiner

[FIG. 1]
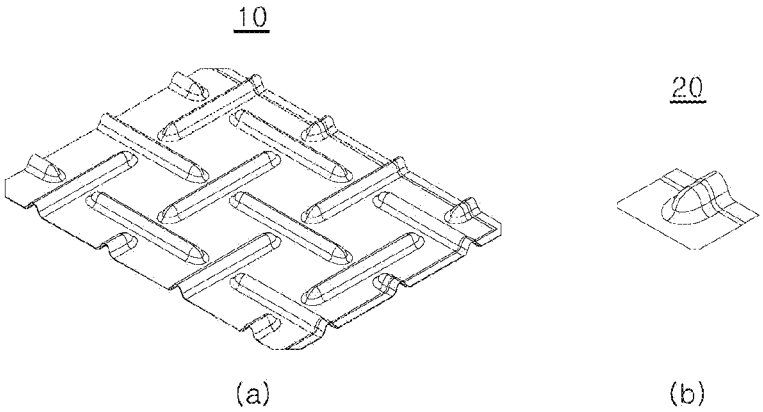
[FIG. 2]
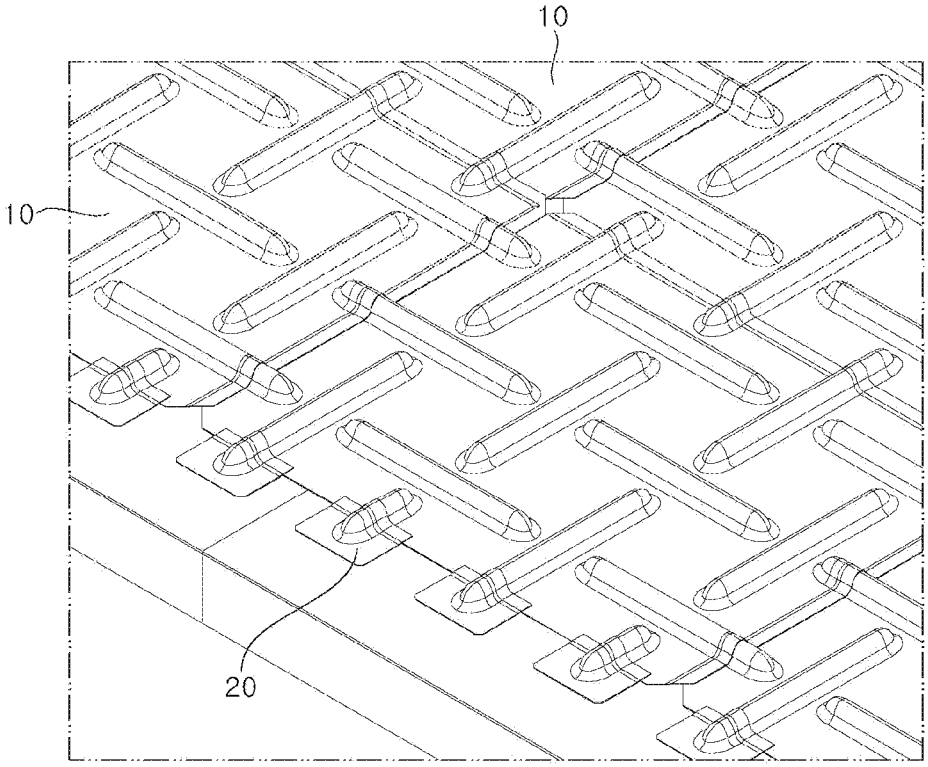

[FIG. 3]
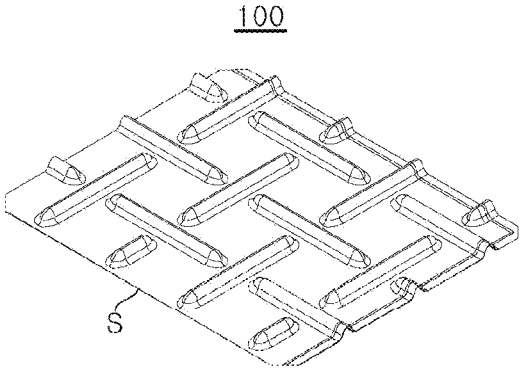
[FIG. 4]
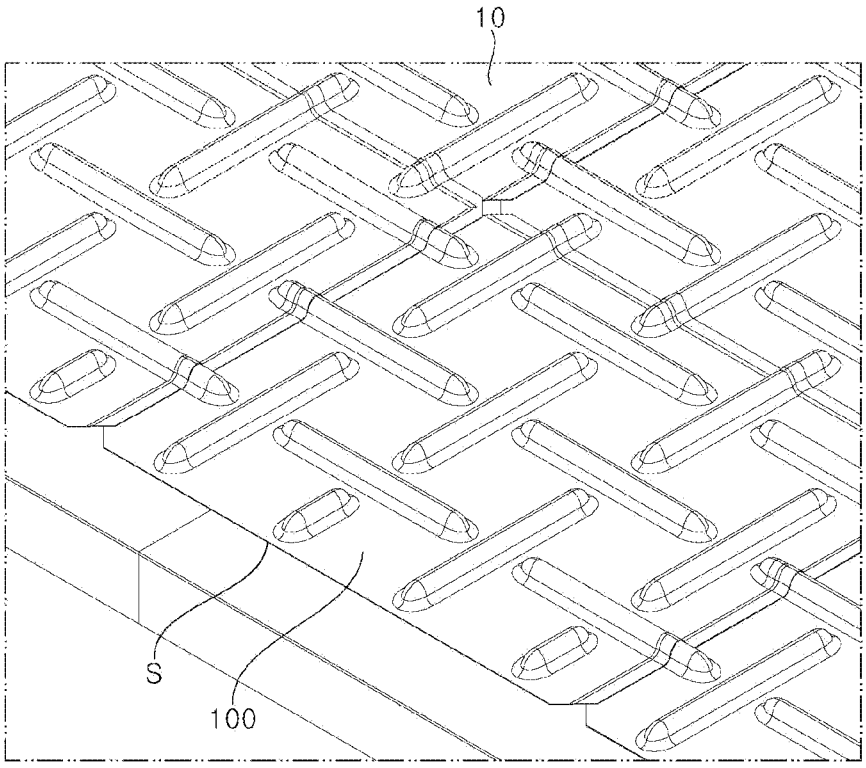

[FIG. 5]
(a)
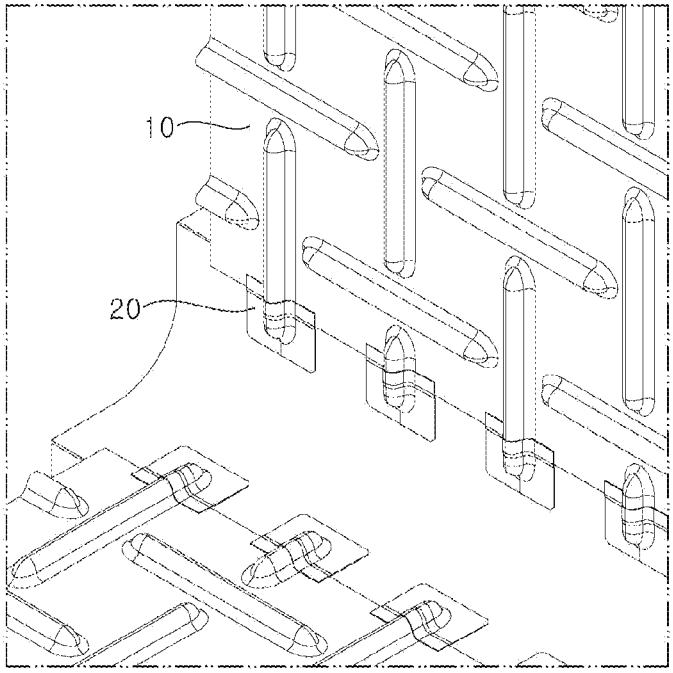
(b)
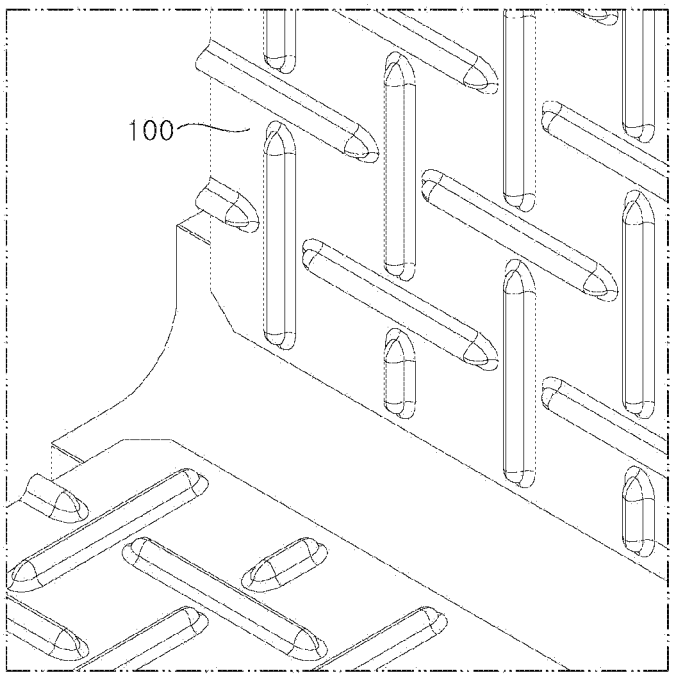

MEMBRANE FINISHING SHEET AND MEMBRANE INSULATION STRUCTURE COMPRISING THE SAME

TECHNICAL FIELD

The present invention relates to a membrane finishing sheet and a membrane insulation structure including the same, and more particularly, to a membrane finishing sheet which is provided to a finishing portion of a membrane and has an improved corrugation structure, and a membrane insulation structure including the same.

BACKGROUND ART

Natural gas is a fossil fuel mainly consisting of methane and containing small amounts of ethane, propane, and the like, and has recently been spotlighted as a low-pollution energy source in various fields.

Natural gas is transported in a gaseous state via onshore or offshore gas piping, or transported to a distant source of demand in the form of liquefied natural gas (LNG) by an LNG carrier. Liquefied natural gas is obtained by cooling natural gas to an extremely low temperature (about −163° C. or less) and is suitable for long-distance transportation by sea since LNG has a volume of about 1/600 that of natural gas in a gaseous state.

An LNG carrier is equipped with a storage tank (also referred to as a 'cargo tank') that can store and retain LNG obtained by cooling and liquefying natural gas. Since the boiling point of LNG is about −162° C. at atmospheric pressure, an LNG storage tank may be formed of materials that can withstand extremely low temperatures, such as aluminum, stainless steel and 35% nickel steel, to safely store and retain LNG and is designed to be resistant to thermal stress and thermal shrinkage and to prevent heat intrusion.

Such storage tanks can be classified into an independent type and a membrane type depending upon the structure thereof.

A typical membrane type storage tank has a stack structure of a primary sealing wall, a primary insulation wall, a secondary sealing wall and a secondary insulation wall. The primary sealing wall adjoins liquefied natural gas stored in the storage tank and is constituted by a 1.2 mm thick stainless steel membrane.

Although stainless steel has good sealing properties and is suitable for a sealing wall, a stainless steel sealing wall is formed with a plurality of corrugations in consideration of large thermal deformation of stainless steel.

FIG. 1 is views of a sealing wall of a typical membrane type storage tank, in which (a) illustrates a membrane sheet and (b) illustrates an endcap, and FIG. 2 is a schematic view of the typical membrane type storage tank.

Referring to FIG. 1 and FIG. 2, the sealing wall of the typical membrane type storage tank is composed of membrane sheets 10 formed with a plurality of corrugations.

In practice, the sealing wall is formed by connecting thousands of membrane sheets 10 having the same shape and formed with a plurality of corrugations, in which the corrugations formed on adjacent membrane sheets 10 connected to each other by welding.

However, since the membrane sheet 10 on a finishing portion of the storage tank is not connected to another membrane sheet, the corrugations on the membrane sheet 10 disposed at the finishing portion must be sealed with a separate finishing member and are typically finished by welding endcaps 20, as shown in FIG. 1.

Such a conventional technique requires separate finishing members such as endcaps, and additional welding operation, thereby causing increase in labor and deterioration in productivity.

DISCLOSURE

Technical Problem

Embodiments of the present invention provide a membrane insulation structure in which corrugations formed on a membrane finishing sheet disposed on a membrane finishing portion of a sealing wall constituted by a plurality of membrane sheets have a closed structure toward the membrane finishing portion to allow elimination of a separate finishing member for membrane sealing.

Technical Solution

In accordance with one aspect of the present invention, there is provided a membrane finishing sheet disposed on a membrane finishing portion of a sealing wall constituted by a plurality of membrane sheets in a membrane type storage tank, wherein, among a plurality of corrugations formed on the membrane finishing sheet, corrugations formed towards the membrane finishing portion have a closed structure.

In accordance with another aspect of the present invention, there is provided a membrane insulation structure including: a membrane finishing sheet (100) disposed on a membrane finishing portion of a sealing wall constituted by a plurality of membrane sheets in a membrane type storage tank; and membrane sheets (10) disposed in remaining regions excluding the membrane finishing portion on which the membrane finishing sheet (100) is disposed, wherein each of the membrane finishing sheet (100) and the membrane sheets (10) includes a plurality of corrugations; the membrane finishing sheet (100) has a rectangular plate shape; among four sides of the membrane finishing sheet (100), a finishing side(s) of the membrane finishing sheet (100) adjoining the membrane finishing portion is formed with corrugations having a closed structure and the three remaining sides of the membrane finishing sheet (100) are formed with corrugations having an open structure.

The finishing side(s) of the membrane finishing sheet (100) may have a flat shape and the corrugations formed on the membrane finishing sheet (100) do not extend to the finishing side(s).

The membrane sheet (10) may have a rectangular plate shape and all four sides of the membrane sheet (10) may be formed with corrugations having an open structure.

In accordance with a further aspect of the present invention, there is provided a membrane insulation structure including a membrane finishing sheet, wherein the membrane finishing sheet is disposed on a membrane finishing portion of a sealing wall constituted by a plurality of membrane sheets in a membrane type storage tank and is integrally formed with endcaps at one side thereof adjoining the membrane finishing portion, thereby allowing elimination of a separate finishing member.

Advantageous Effects

According to the present invention, the membrane finishing sheet allows elimination of a separate finishing member for sealing a membrane finishing portion and does not require operation for welding the separate finishing member, such as an endcap, thereby enabling reduction in material costs and labor.

In addition, the membrane finishing sheet according to the present invention can reduce a curve welding operation for welding a separate finishing member, such as an endcap, thereby improving operation convenience for welding while simplifying installation of membrane sheets.

DESCRIPTION OF DRAWINGS

FIG. 1 is views of a sealing wall of a typical membrane type storage tank, in which (a) illustrates a membrane sheet and (b) illustrates an endcap, and.

FIG. 2 is a schematic view of the typical membrane type storage tank.

FIG. 3 is a perspective view of a membrane finishing sheet according to one embodiment of the present invention.

FIG. 4 is a schematic view of a membrane type storage tank adopting the membrane finishing sheet according to the embodiment of the present invention.

FIG. 5 shows (a) a schematic view of a corner of a typical membrane type storage tank and (b) a schematic view of a corner of the membrane type storage tank according to the embodiment of the present invention.

BEST MODE

The above and other aspects, features, and advantages of the present invention will become apparent from the detailed description of the following embodiments in conjunction with the accompanying drawings.

Hereinafter, embodiments of the present invention will be described in detail with reference to the accompanying drawings. It should be understood that like components will be denoted by like reference numerals throughout the specification and the accompanying drawings.

In addition, detailed description of known functions and constructions which can unnecessarily obscure the subject matter of the present invention will be omitted.

FIG. 3 is a perspective view of a membrane finishing sheet according to one embodiment of the present invention and FIG. 4 is a schematic view of a membrane type storage tank adopting the membrane finishing sheet according to the embodiment of present invention.

Referring to FIG. 3, a membrane finishing sheet 100 according to one embodiment of the invention includes a plurality of corrugations and, among four sides of the membrane finishing sheet 100, one side of the membrane finishing sheet 100 adjoining a membrane finishing portion (hereinafter referred to as 'finishing side') is formed with corrugations having a closed structure.

That is, the finishing side(s) of the membrane finishing sheet 100 has a flat shape and the corrugations formed on the membrane finishing sheet 100 do not extend to the finishing side.

In other words, the finishing side(s) of the membrane finishing sheet 100 is not finished with a separate endcap and the membrane finishing sheet 100 is integrally formed with endcaps at the finishing side(s) thereof.

The three remaining sides of the membrane finishing sheet 100 excluding the finishing side(s) thereof facing the membrane finishing portion are formed with corrugations having an open structure. As shown in FIG. 4, the corrugations having an open structure and formed on the membrane finishing sheet 100 are connected to corrugations formed on a membrane sheet adjacent thereto. Here, connection between adjacent corrugations may be realized by welding.

Referring to FIG. 4, a membrane insulation structure including the membrane finishing sheet according to the present invention will be described.

The membrane insulation structure according to the present invention includes a sealing wall formed on each of inner walls of a storage tank to secure liquid tightness of the storage tank storing liquefied gas, in which the sealing wall is constituted by connecting a plurality of membrane sheets 10 each having corrugations to one another and the membrane finishing sheet 100 according to the present invention is disposed in the outermost region on the sealing wall.

That is, the membrane finishing sheet 100 is disposed in a region of the sealing wall adjoining the membrane finishing portion and the membrane sheets 10 are disposed in the remaining regions of the sealing wall.

Each of the membrane sheets 10 and the membrane finishing sheet 100 may be formed with a plurality of corrugations thereon. Here, the membrane finishing sheet 100 includes the plurality of corrugations, as described above, in which the finishing side(s) of the membrane finishing sheet 100 adjoining the membrane finishing portion is formed with corrugations having a closed structure and the three remaining sides thereof are formed with corrugations having an open structure.

The corrugations having an open structure and formed on each of the membrane sheets 10 and the membrane finishing sheet 100 may be connected to corrugations having an open structure and formed on a membrane sheet adjacent thereto by welding.

With this structure, the membrane insulation structure can improve convenience in welding operation through elimination of an operation for welding a separate finishing member, such as an endcap, to a membrane sheet adjoining the membrane finishing portion, thereby reducing labor while improving productivity.

In addition, the membrane finishing sheet according to the present invention may be applied to a corner of a membrane type storage tank, which has an inclined surface.

FIG. 5 shows (a) a schematic view of a corner of a typical membrane type storage tank and (b) a schematic view of a corner of the membrane type storage tank according to the embodiment of the present invention.

Referring to (a) of FIG. 5, a typical membrane type storage tank requires operation for welding separate endcaps 20 to a membrane sheet 10 in order to seal corrugations formed on the membrane sheet 10 and having an open structure.

On the other hand, referring to (b) of FIG. 5, the membrane finishing sheet 100 according to the present invention may be applied to a corner of a membrane type storage tank, thereby improving convenience in welding operation through elimination of a separate finishing operation.

It will be apparent to those skilled in the art that the present invention is not limited to the embodiments described above and that various modifications, changes, alterations, and equivalent embodiments can be made without departing from the spirit and scope of the present invention. Therefore, such modifications, changes, alterations, and equivalent embodiments fall within the spirit and scope of the claims.

The invention claimed is:

1. A membrane insulation structure of a membrane type storage tank, the membrane insulation structure comprising:

an insulation layer; and a sealing wall disposed over the insulation layer, wherein the sealing wall comprises a plurality of membrane sheets and a plurality of membrane finishing sheets, wherein each of the plurality of membrane sheets is connected to a neighboring one of the plurality of membrane sheets, and each of the plurality of membrane finishing sheets is connected a neighboring one of the plurality of membrane sheets, each membrane finishing sheet of the plurality of membrane finishing sheets comprising a finishing side configured to form a membrane finishing end portion of the sealing wall, wherein each membrane sheet of the plurality of membrane sheets comprises a plurality of sides, wherein each membrane finishing sheet of the plurality of membrane finishing sheets comprises a plurality of sides comprising the finishing side and a connecting side connected to a neighboring one of the plurality of membrane sheets, wherein each of the plurality of membrane finishing sheets and the plurality of membrane sheets comprises a plurality of corrugations comprising open ended corrugations, wherein each open ended corrugation comprises an open structure located at one of the plurality of sides of the plurality of membrane sheets and the plurality of membrane finishing sheets except the finishing side, wherein the finishing side does not comprise the open structure of any of the open ended corrugations while the connecting side of each of the plurality of membrane finishing sheets comprises the open structure of at least one of the open ended corrugations such that the membrane finishing end portion of the sealing wall does not comprise the open structure of any of the open ended corrugations, wherein the plurality of sides of each of the plurality of membrane finishing sheets comprise an additional connecting side that is connected to a neighboring one of the plurality of membrane finishing sheets, wherein the additional connecting side comprises the open structure of at least one of the open ended corrugations.

2. The membrane insulation structure according to claim 1, wherein the finishing side has a flat shape and the plurality of corrugations formed on each membrane finishing sheet do not extend to the finishing side.

3. The membrane insulation structure according to claim 1, wherein each of the plurality of membrane sheets has a rectangular plate shape and the plurality of sides of each membrane sheet comprise four sides comprising the open ended corrugations.

4. The membrane insulation structure of claim 1, wherein the plurality of corrugations of each membrane finishing sheet comprise closed end corrugations extending toward the finishing side, and each of the closed end corrugations comprises a closed structure spaced from the finishing side.

5. The membrane insulation structure of claim 1, wherein the insulation layer comprises a first surface and a second surface meeting at a corner, wherein the plurality of membrane finishing sheets comprise a first membrane finishing sheet placed over the first surface such that the finishing side of the first membrane finishing sheet is spaced from the corner and a second membrane finishing sheet placed over the second surface such that the finishing side of the second membrane finishing sheet is spaced from the corner.

* * * * *